US006862745B2

(12) United States Patent
Grilliot et al.

(10) Patent No.: US 6,862,745 B2
(45) Date of Patent: Mar. 8, 2005

(54) FACE MASK, HEAD HARNESS, AND PROTECTIVE HOOD FOR FIREFIGHTER

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 41 days.

(21) Appl. No.: 10/405,521

(22) Filed: Apr. 2, 2003

(65) Prior Publication Data

US 2004/0064867 A1 Apr. 8, 2004

Related U.S. Application Data

(63) Continuation-in-part of application No. 10/265,863, filed on Oct. 7, 2002, now Pat. No. 6,691,314.

(51) Int. Cl.[7] ..... A42B 1/04
(52) U.S. Cl. ..... 2/205; 2/424; 128/201.29
(58) Field of Search ..... 2/424, 202, 205; 128/201.22, 201.29, 202.11

(56) References Cited

U.S. PATENT DOCUMENTS 2,800,901 A * 7/1957 Monro ..... 128/201.15
3,535,706 A * 10/1970 Alieo ..... 2/5
4,573,217 A 3/1986 Reed
4,972,520 A 11/1990 Grilliot et al.
5,069,205 A * 12/1991 Urso ..... 128/201.24
5,309,571 A * 5/1994 Huang ..... 2/458
5,924,420 A * 7/1999 Reischel et al. ..... 128/206.21
6,006,360 A 12/1999 Reed
6,266,828 B1 7/2001 Corsini
6,328,031 B1 12/2001 Tischer et al.
6,478,025 B1 11/2002 Yort et al.
6,578,572 B2 6/2003 Tischer et al.

FOREIGN PATENT DOCUMENTS

DE 3509784 A1 * 9/1986 ..... A62B/17/04
EP 54154 A1 * 6/1982 ..... A62B/17/04

* cited by examiner

*Primary Examiner*—Rodney M. Lindsey
(74) *Attorney, Agent, or Firm*—Wood, Phillips, Katz, Clark & Mortimer

(57) ABSTRACT

For a firefighter, rescue worker, or chemical worker or another wearer needing head protection, a protective hood, a fitment, a face mask, and a head harness are combined. The head harness is attached to the face mask, at an upper portion of the face mask, so as to secure the face mask to the wearer's head, when the face mask and the head harness are worn. The protective hood is attached detachably to the face mask, at a lower portion of the face mask, but is not attached elsewhere. The protective hood is adapted to cover the wearer's head and to cover the head harness, except for a frontal region of the wearer's head, when the protective hood, the face mask, and the head harness are worn. The fitment is attachable to the face mask.

6 Claims, 1 Drawing Sheet

FACE MASK, HEAD HARNESS, AND PROTECTIVE HOOD FOR FIREFIGHTER

CROSS-REFERENCE TO RELATED APPLICATION

This invention is a continuation-in-part of U.S. patent application Ser. No. 10/265,863, now U.S. Pat. No. 6,691,314, which was filed on Oct. 7, 2002, and the disclosure of which application is incorporated herein by reference.

TECHNICAL FIELD OF THE INVENTION

This invention pertains generally to protective gear for a firefighter, rescue worker, or chemical worker or another wearer needing head protection and respiratory assistance. This invention pertains particularly to a face mask, a head harness, and a protective hood, in a novel combination. The novel combination may comprise a fitment, such as a regulator for a self-contained breathing apparatus or such as a respirator containing an air filter.

BACKGROUND OF THE INVENTION

Commonly, a firefighter, rescue worker, or chemical worker or another wearer needing head protection is required to wear a face mask secured removably to the wearer's head, via a head harness, which is attached detachably to the face mask, via fasteners at or near an outer perimeter of the face mask. Commonly, a fitment is secured removably to the face mask. The fitment may be an element of a self-contained breathing apparatus, such as a regulator, or the fitment may be a respirator, to which an air filter is mounted.

Along with the face mask, the firefighter may be also required to wear a protective hood, which provides a fire-retardant, thermally insulative barrier protecting the wearer's head, except for at least a portion of the wearer's face where the face mask is worn, and protecting the wearer's neck, and which is worn over the head harness and over at least part of an outer perimeter of a window portion of the face mask. As exemplified in U.S. Pat. No. 6,266,828, U.S. Pat. No. 6,328,031, and U.S. Pat. No. 6,478,025, the disclosures of which patents are incorporated herein by reference, it is known for the protective hood to be directly and detachably attached to the face mask, as via similar fasteners used to attach the head harness detachably to the face mask.

SUMMARY OF THE INVENTION

For a firefighter, rescue worker, or chemical worker or another wearer needing head protection, this invention provides a face mask, a head harness, and a protective hood, in a novel combination. The novel combination may comprise a fitment, such as a regulator for a self-contained breathing apparatus or such as a respirator containing an air filter.

The head harness is attached to the face mask, at an upper portion of the face mask, so as to secure the face mask to the wearer's head, when the face mask and the head harness are worn. The protective hood is attached to the face mask, at a lower portion of the face mask but not elsewhere. The protective hood is adapted to cover the wearer's head and to cover the head harness, except for a frontal region of the wearer's head, when the protective hood, the face mask, and the head harness are worn. If a fitment is provided, as mentioned above, the fitment is attachable to the face mask.

Furthermore, this invention provides a novel method of preparing and donning a protective hood, a face mask, and a head harness. As preliminary steps, the novel method comprises attaching the head harness to the face mask and attaching the protective hood to the face mask. As subsequent steps, the novel method comprises donning the face mask and the head harness so as to secure the face mask to the wearer's head and donning the protective hood so as to cover the wearer's head, except for a frontal region of the wearer's head.

DETAILED DESCRIPTION OF THE ILLUSTRATED EMBODIMENT

Figure 1:
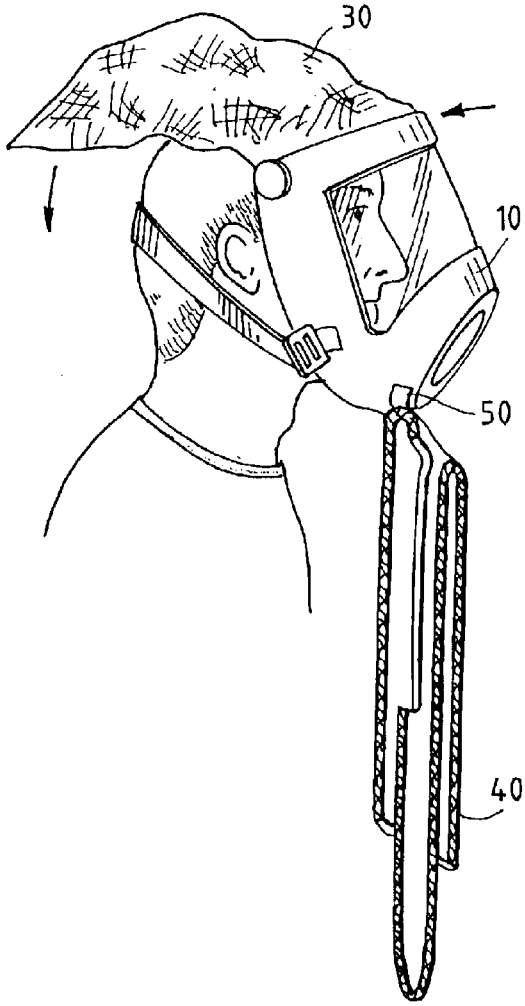
FIG. 1 is a perspective view of a face mask, a head harness attached to the face mask, and a protective hood attached to the face mask, as the face mask and the head harness are being donned by a wearer, before the protective hood is donned.

As illustrated, this invention provides a face mask 10, a fitment 20, a head harness 30, and a protective hood 40, in a novel combination, for a firefighter, rescue worker, or chemical worker or another wearer needing head protection and respiratory assistance.

The head harness 30 is attached to the face mask 10, at an upper portion of the face mask 10, so as to secure the face mask 10 to the wearer's head, when the face mask 10 and the head harness 30 are worn. Except as illustrated and described herein, the face mask 10 may conform to the face mask disclosed in U.S. patent application Ser. No. 10/265,863, supra, to the face mask disclosed in U.S. Pat. No. 6,266,828, supra, or to the face mask disclosed in U.S. Pat. No. 6,328,031, supra. Except as illustrated and described herein, the head harness 30 may conform to the head harness disclosed in U.S. patent application Ser. No. 10/265,863, supra, or to the head harness disclosed in U.S. Pat. No. 6,328,031, supra.

The protective hood 40 is adapted to cover the wearer's head, except for a frontal region of the wearer's head, when the protective hood 40 is worn. Except as illustrated and described herein, the protective hood 40 may conform to the protective hood disclosed in U.S. Pat. No. 4,972,520, the disclosure of which patent is incorporated herein by reference, or to other protective hoods sold commercially, heretofore, by Morning Pride Manufacturing, L.L.C. of Dayton, Ohio. The protective hood 40 is attached detachably to the face mask 10, at a lower portion of the face mask 10 but not elsewhere, by any suitable means. As illustrated, the protective hood 40 is attached to the face mask 10 by a hook-and-loop (e.g. VELCRO™) fastener 50. The protective hood 40 may be alternatively attached to the face mask 10 by a snap fastener, by a plurality of snap fasteners, or by other, equivalent fasteners.

In a preferred embodiment, the fitment 20 is a regulator of a self-contained breathing apparatus, of which the regulator is an element. In an alternative embodiment, the fitment 20 is a respirator, to which an air filter is mounted. Details of such a regulator, details of other elements of such a breathing apparatus, details of such a respirator, and details of such an air filter are outside the scope of this invention and can be readily supplied by persons having ordinary skill in the relevant art. The fitment 20 is attachable detachably to the face mask 10, as via a bayonet connection requiring a quarter turn of the face mask 10 relative to the fitment 20 or a quarter turn of the fitment 20 relative to the face mask 10, either to attach the fitment 20 to the face mask 10 or to detach the fitment 20 from the face mask 10.

As illustrated in the drawings, the face mask 10, the fitment 20, the head harness 30, and the protective hood 40 are prepared by preliminary steps of attaching the head harness 30 to the face mask 10, in a known manner, and attaching the protective hood 40 to lower portion of the face mask 10, as described above. As illustrated in FIG. 1, the protective hood 40 is able to hang downwardly from the lower portion of the face mask 10, after the protective hood 40 has been attached to the lower portion of the face mask 10 and before the protective hood 40 has been donned. Desirably, these preliminary steps are performed before a firefighter, rescue worker, or chemical worker or another wearer needing head protection is called to a tactical situation. Preliminarily, in a preferred mode for carrying out this invention, the fitment 20 remains detached from the face mask 10.

Figure 2:
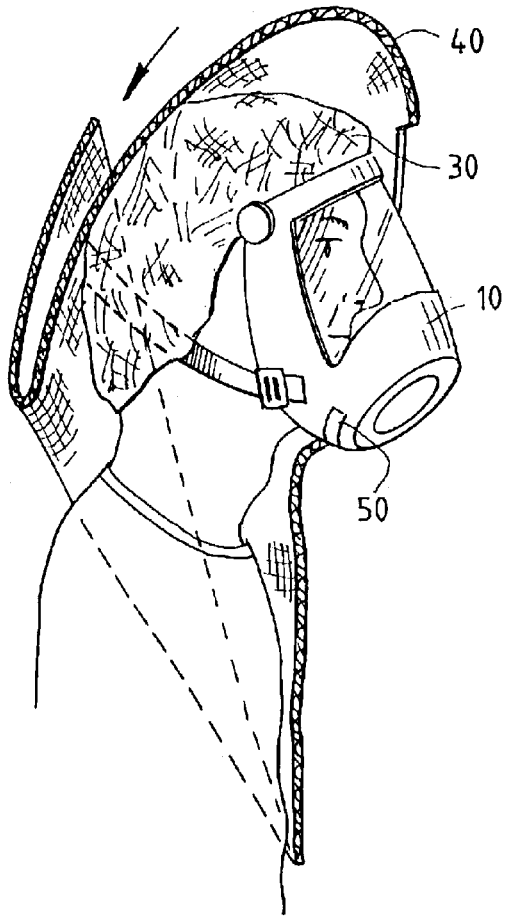
FIG. 2 is a perspective view thereof, after the face mask and the head harness have been donned, as the protective hood is being donned by the wearer.
Figure 3:
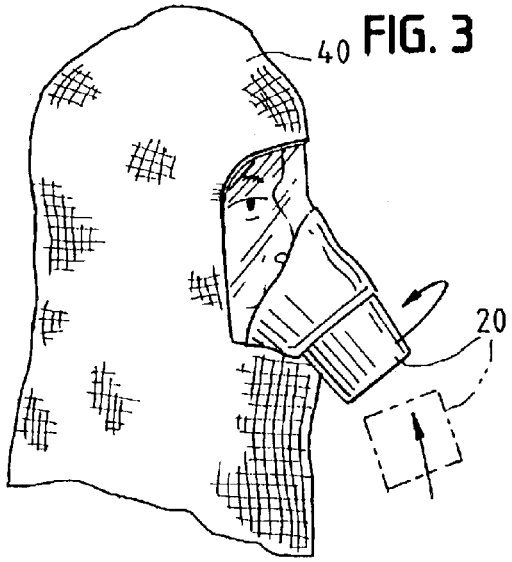
FIG. 3 is a perspective view thereof, after the protective hood has been donned by the wearer, as a fitment is being attached to the face mask.

As in a tactical situation, the face mask 10, the head harness 30, and the protective hood 40 can be then donned by subsequent steps of donning the face mask 10 and the head harness 30 so as to secure the face mask 10 to the wearer's head, and, thereupon, donning the protective hood 40 so as to cover the wearer's head, except for the frontal region of the wearer's head. As illustrated sequentially in FIGS. 1, 2, and 3, when the protective hood 40 is donned, the protective hood 40 is pulled over the wearer's head and over the head harness 30, after the protective hood 40 has been attached to the lower portion of the face mask 10 and while the protective hood 40 remains attached to the lower portion of the face mask 10. Subsequently, in the preferred mode for carrying out this invention, the fitment 20 is attached to the face mask 10, as described above.

What is claimed is:

1. For a firefighter, rescue worker, or chemical worker or another wearer needing head protection, a combination comprising a protective hood, a face mask, and a head harness, wherein the head harness is attached to the face mask, so as to secure the face mask to the wearer's head, when the face mask and the head harness are worn, wherein the protective hood is attached to the face mask, at a lower portion of the face mask but not elsewhere, wherein the protective hood is able to hang downwardly from the lower portion of the face mask, after the protective hood has been attached to the lower portion of the face mask and before the protective hood has been donned, and wherein the protective hood is adapted to be donned by being pulled over the wearer's head and over the head harness, while the protective hood is attached to the lower portion of the face mask, so as to cover the wearer's head and to cover the head harness, except for a frontal region of the wearer's head, when the protective hood, the face mask, and the head harness are worn.

2. The combination of claim 1 further comprising a fitment, which is attachable to the face mask.

3. The combination of claim 1 wherein the protective hood is attached detachably to the face mask, at the lower portion of the face mask but not elsewhere.

4. For a firefighter, rescue worker, or chemical worker or another wearer needing head protection, a method of preparing and donning a protective hood, a face mask, and a head harness, the method comprising preliminary steps of attaching the head harness to the face mask and attaching the protective hood to the face mask, at a lower portion of the face mask but not elsewhere, so that the protective hood is able to hang downwardly from the lower portion of the face mask, and subsequent steps of donning the face mask and the head harness, so as to secure the face mask to the wearer's head, and donning the protective hood, by pulling the protective hood over the wearer's head and over the head harness, while the protective hood is attached to the lower portion of the face mask, so as to cover the wearer's head and the head harness, except for a frontal region of the wearer's head.

5. The method of claim 4 further comprising a step of attaching a fitment to the face mask, after the face mask and the head harness have been donned, and after the protective hood has been donned.

6. The method of claim 4 wherein the step of attaching the protective hood to the face mask comprises attaching the protective hood detachably to the face mask.

* * * * *